US008302352B2

(12) United States Patent
Bahn

(10) Patent No.: US 8,302,352 B2
(45) Date of Patent: Nov. 6, 2012

(54) ROOF VENTILATION SYSTEM

(76) Inventor: Richard Stuart Bahn, Gallatin, TN (US)

( * ) Notice: Subject to any disclaimer, the term of this patent is extended or adjusted under 35 U.S.C. 154(b) by 192 days.

(21) Appl. No.: 12/871,488

(22) Filed: Aug. 30, 2010

(65) Prior Publication Data

US 2012/0047828 A1 Mar. 1, 2012

(51) Int. Cl.
*E04B 7/00* (2006.01)
*F24F 7/02* (2006.01)

(52) U.S. Cl. ..... 52/199; 52/95

(58) Field of Classification Search ..... 52/95, 198, 52/199, 302.1, 302.2, 302.4, 302.6; 454/365; D25/141, 143
See application file for complete search history.

(56) References Cited

U.S. PATENT DOCUMENTS 4,287,241 A * 9/1981 Kaufmann ..... 427/403
4,876,950 A * 10/1989 Rudeen ..... 454/365
5,167,579 A 12/1992 Rotter
5,174,076 A * 12/1992 Schiedegger et al. ..... 52/199
5,352,154 A 10/1994 Rotter et al.
5,425,672 A * 6/1995 Rotter ..... 454/365
5,458,538 A * 10/1995 MacLeod et al. ..... 454/365
5,561,953 A 10/1996 Rotter
5,826,383 A 10/1998 Garrison
5,830,059 A * 11/1998 Sells ..... 454/365
5,965,626 A * 10/1999 Tzeng et al. ..... 521/101
6,079,166 A 6/2000 Mason et al.
6,108,992 A * 8/2000 Shaw ..... 52/302.3
6,325,712 B1 * 12/2001 Lawless et al. ..... 454/277
6,418,678 B2 7/2002 Rotter
6,458,029 B2 * 10/2002 Morris ..... 454/365
6,589,113 B2 * 7/2003 Sells ..... 454/365
6,599,184 B2 * 7/2003 Morris ..... 454/365
6,662,510 B2 12/2003 Rotter
6,773,342 B2 8/2004 Rotter
6,780,099 B1 * 8/2004 Harper ..... 454/186
7,594,363 B2 * 9/2009 Polumbus et al. ..... 52/199
8,024,897 B2 * 9/2011 Polumbus et al. ..... 52/199
2011/0189940 A1 * 8/2011 Kerwood-Winslow et al. ..... 454/365

* cited by examiner

*Primary Examiner* — Brian Glessner
*Assistant Examiner* — Joseph J Sadlon
(74) *Attorney, Agent, or Firm* — James Addison Barry, Jr.

(57) ABSTRACT

A roof vented closure strip 200 comprises profile piece 210, filter material 220, and top layer 230, the strip manufactured with at least two different materials combining to fill the space between a ridge cap 140 and a sloped roof 112. The profile piece includes a lower surface 213, side surfaces 215, a front exterior surface 216, a rear interior surface 217. The strip is disposed on the sloped roof such that a lip is formed between strip rear interior surface, and the ridge slot. Filter material fills between the profile piece, the top layer, the front exterior surface, and the rear interior surface wherein the rear interior surface slopes at an angle 206 toward front exterior surface, and one or more moisture channel 250 extends laterally across the width of the strip, such that moisture flows from the lip down and drains through the moisture channel exiting the structure.

12 Claims, 6 Drawing Sheets

ROOF VENTILATION SYSTEM

FIELD OF INVENTION

The present invention relates to the general field of roof ventilation systems. It is specifically related to air permeable roof ridge ventilation.

BACKGROUND OF INVENTION

It is common to ventilate attics and roofs of building structures to remove stagnant or hot air with ventilating systems. A common ventilating system includes an open slot running along the length of the roof ridge causing ventilation of the attic by convection airflow and the wind blowing across the roof creating a negative pressure and moving the interior air to the exterior. The vents are provided to permit ingress and egress of gas or air. Ridge vents are typically combined with gable or soffit vents through which air can flow into the space below the roof to encourage a continuous flow of air from the ambient environment, through the space beneath the roof and back to the ambient environment through the ridge vent.

For centuries inventors have tried to solve problems associated with vents which simply consist of openings in the structure of a building, through which air can readily pass. One problem is that insects, rain, moisture, or other undesirable elements can also pass through the openings into the structure. Accordingly, ridge vents, that use an air permeable material such as a matting of randomly oriented interconnected or reticulated synthetic fibers, or a less dense air permeable material construction, have been used to attempt to inhibit the passage of insects or rain while permitting the flow of air. These types of materials were used to provide a desirable air permeable sealant material for use with ridge vents. Examples of reticulated materials in ridge vents are found in U.S. Pat. No. 5,561,953 and U.S. Pat. No. 5,167,579. In addition, an example of a strip with two materials, one having a greater concentration of matter for contact with a metal roof in comparison to the other material that was described as less dense for use in allowing air to permeate the material, is found in U.S. Pat. No. 7,594,363. In U.S. Pat. No. 7,594,363, the material of greater density or greater concentration of matter has a smoother surface for engaging the roof section and the less dense material with a more porous surface filters the air and engages the ridge cap. Yet another venting system for ridge vents is disclosed in U.S. Pat. No. 5,352,154 that is similar to U.S. Pat. No. 5,167,579. However, U.S. Pat. No. 5,352,154 further includes metal ridge cap and clips for retaining the mat material position. The invention disclosed in U.S. Pat. No. 5,561,953 was developed to provide a system wherein the reticulated material is shaped on a bottom surface to conform with the transverse contour of an underlying roof such as might be found on tile roofs, corrugated aluminum roofs, metal roofs having upstanding projections and the like. Disadvantages of ridge ventilation systems of the type disclosed in U.S. Pat. Nos. 5,561,953; 5,352,154; or 5,167,579 reside in the fact that the reticulated material rests directly on the underlying roof surface. Since the reticulated material is a very open material that does not present a continuous flat, smooth surface to the underlying roof, it does not provide a desirable sealable surface between the ridge vent system and the underlying roof. U.S. Pat. No. 7,594,363 attempts to provide a smoother surface for a better seal however condensation may be trapped on the interior of the vent system. U.S. Pat. No. 6,773,342 recognized the problem of moisture on the interior of a vent system with an upper water barrier and a lower water dam to attempt to prevent water from entering but again does not provide a method for draining the moisture once present. U.S. Pat. No. 5,826,383 and U.S. Pat. No. 6,079,166 attempt to drain the moisture on the interior of a vent system once the moisture is present by including weep holes, however this method has not proved to be as effective as desired. Accordingly, it would be desirable that a ridge vent system include a vented closure strip that was not only air permeable so that the building structure was adequately ventilated, but also a system whereby the sealant strip could be positively sealed to the underlying roof and ridge cap above to prevent the ingress of rain, insects or the like between the sealant strip and the roof as well as the ridge cap and in addition allow for the condensate and moisture trapped in the area of the ridge vent to effectively drain. It is to overcome the shortcomings in prior art systems and to provide a new and improved system for sealing a ridge roof vent that the present invention has been developed.

SUMMARY

The present invention provides an improved air permeable ventilation sealant system for a ridge vent found in building structures wherein the sealant strip can be positively sealed to the underlying roof and the upper ridge cap while allowing for removal of moisture that has accumulated on the interior side of the ridge vent system with the use of a lip, angled surfaces and a moisture channel.

BRIEF DESCRIPTION OF THE DRAWINGS

These and other features, aspects, and advantages of the invention will become better understood with regard to the following description, appended claims, and accompanying drawings where:

DETAILED DESCRIPTION OF THE INVENTION

The present invention relates to the general field of roof ventilation systems. More specifically an improved air permeable roof closure ventilation. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

Figure 1:
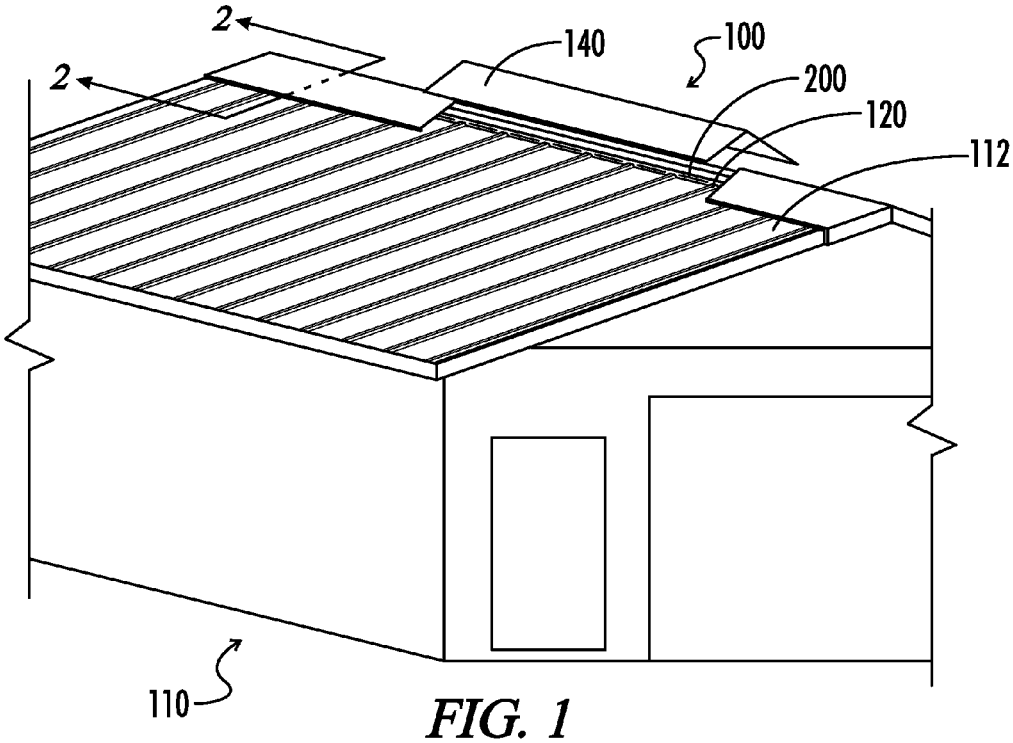
FIG. 1 is a perspective view of one embodiment of a building structure including a roof vented closure strip.
Figure 2:
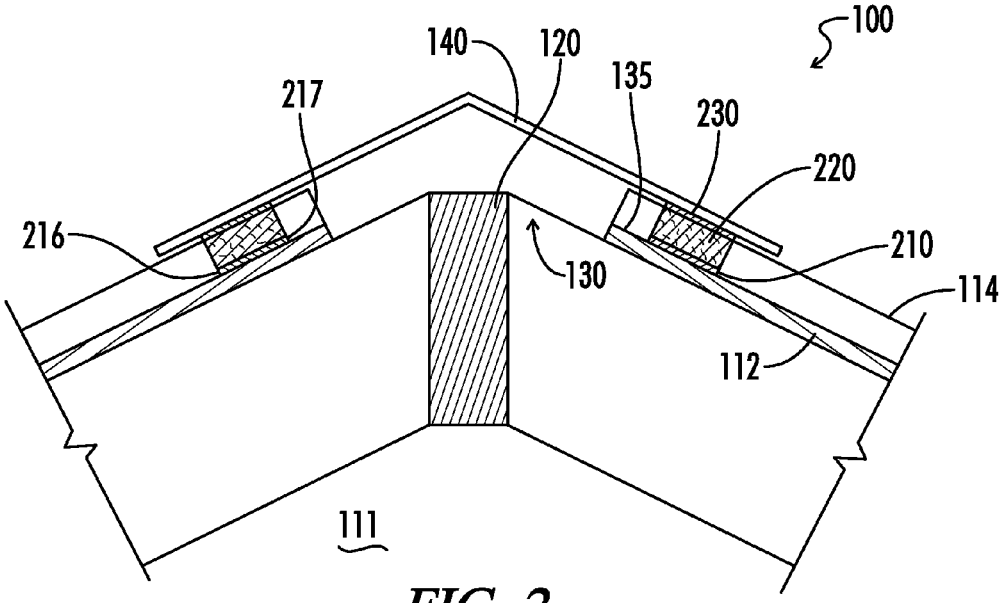
FIG. 2 is a sectional view taken along line 2-2 of FIG. 1.
Figure 3A:
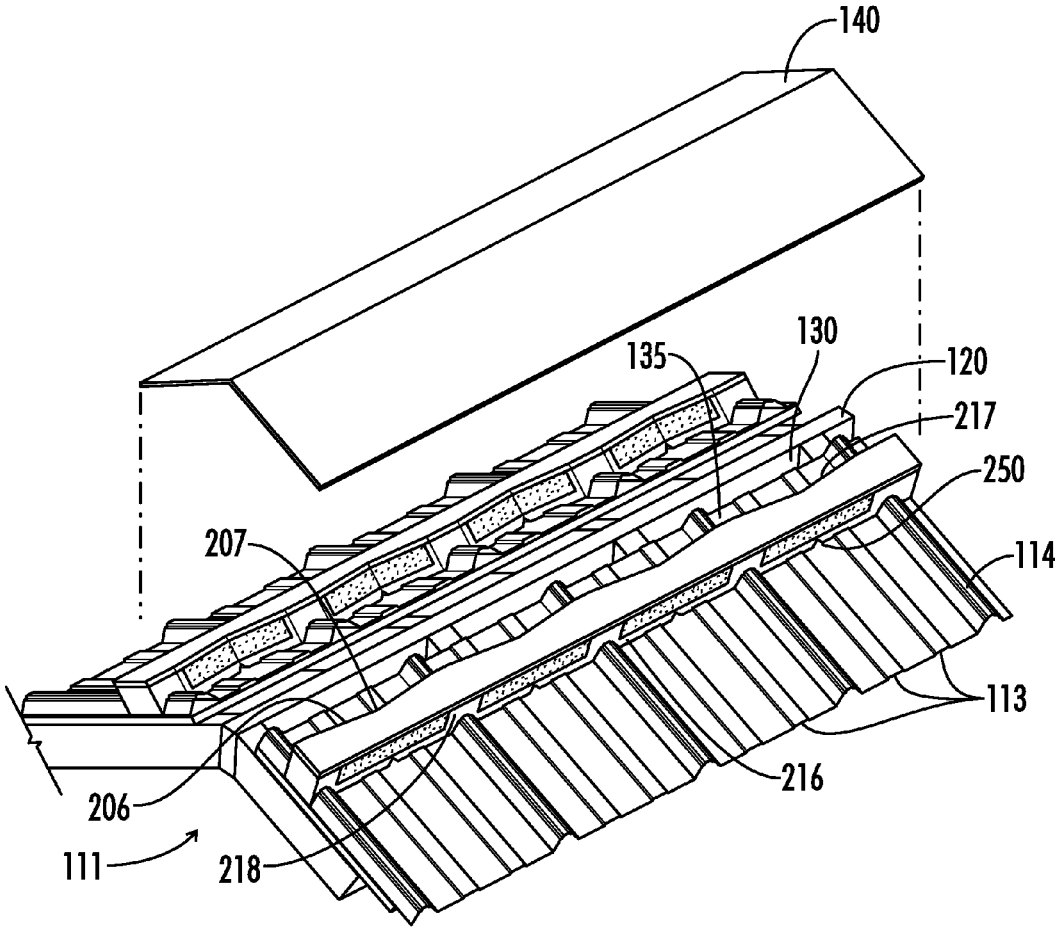
FIG. 3A is a perspective view of one embodiment of a roof vented closure strip in combination with a roof panel and a ridge cap.
Figure 3B:
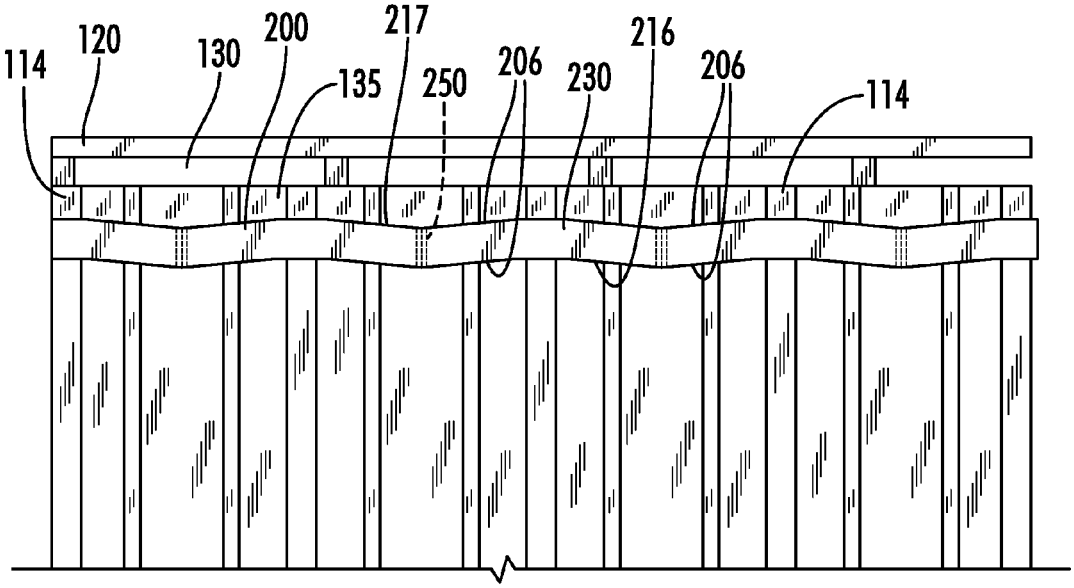
FIG. 3B is a top view of one embodiment of a roof vented closure strip in combination with a roof panel, roof ridge, ridge slot, lip and multiple angles with the vented strip.
Figure 4:
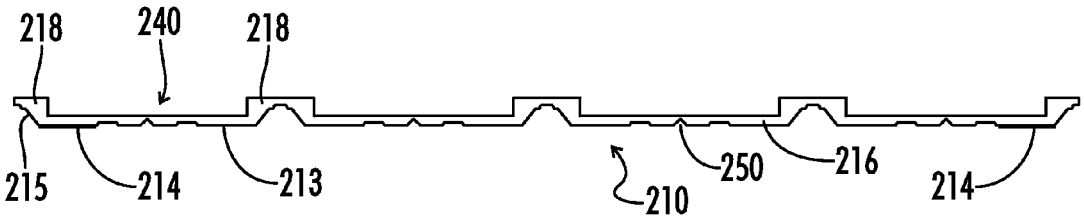
FIG. 4 is a front exterior surface view of one embodiment of a profile piece depicting rectangular recess, bridges, and moisture channel.
Figure 5:
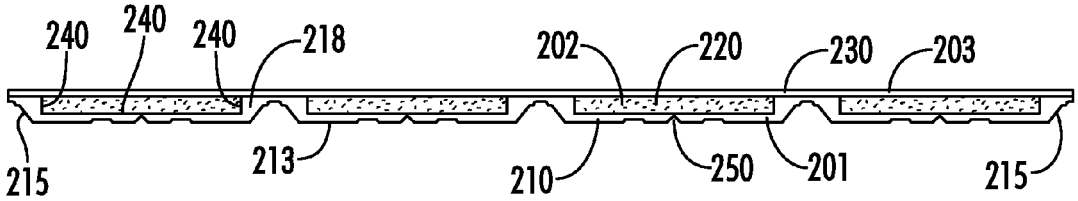
FIG. 5 is a front exterior surface view of one embodiment of a profile piece depicting a relationship of a profile piece, a filter material and a top layer without angles on the front exterior surface.
Figure 6A:
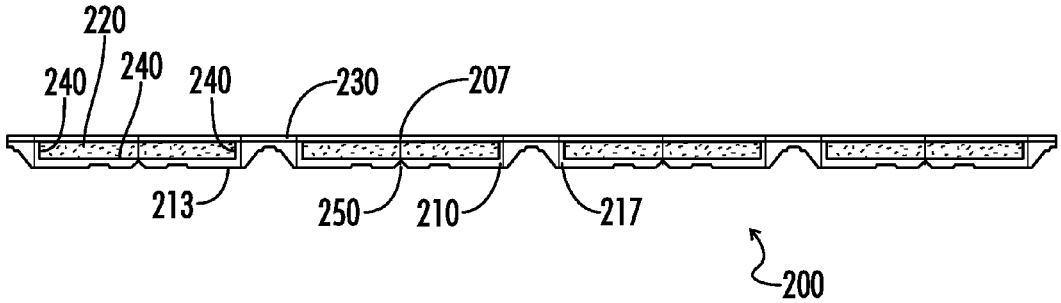
FIG. 6A is a rear interior surface view of one embodiment of a roof vented closure strip depicting a relationship of a profile piece, a filter material and a top layer.
Figure 6B:
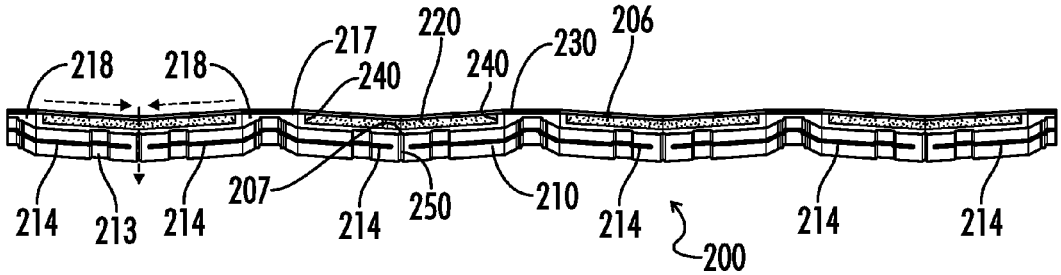
FIG. 6B is a partial perspective view of FIG. 6A illustrating a rear interior surface angle and moisture channel.
Figure 6C:
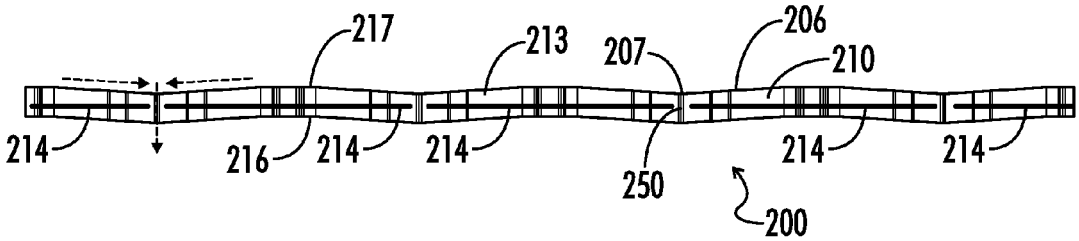
FIG. 6C is a bottom view of FIG. 6A.
Figure 7:
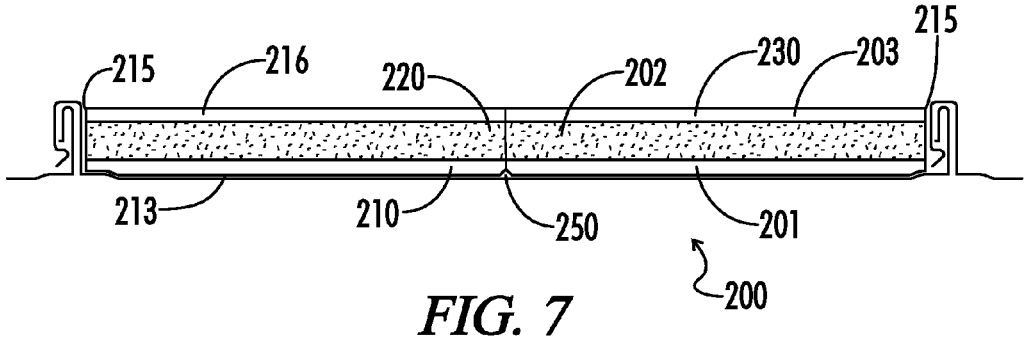
FIG. 7 is a front view of another embodiment of a roof vented closure strip without recesses and bridges.
Figure 8:
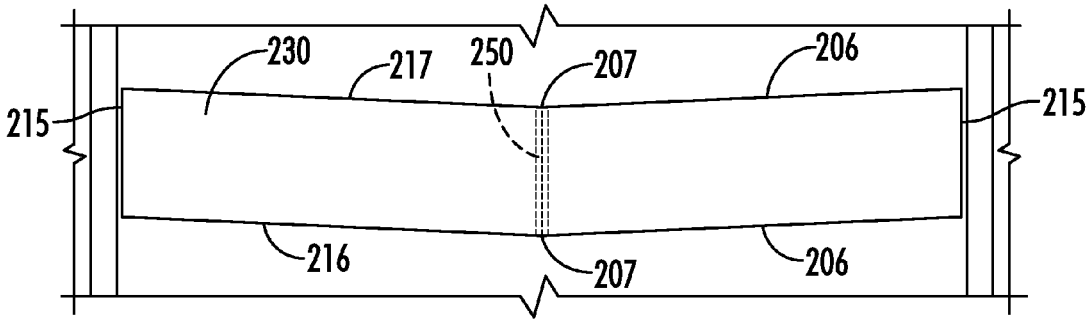
FIG. 8 is a top view of the FIG. 7 embodiment showing the angle and vertex of a roof vented closure strip.
Figure 9:
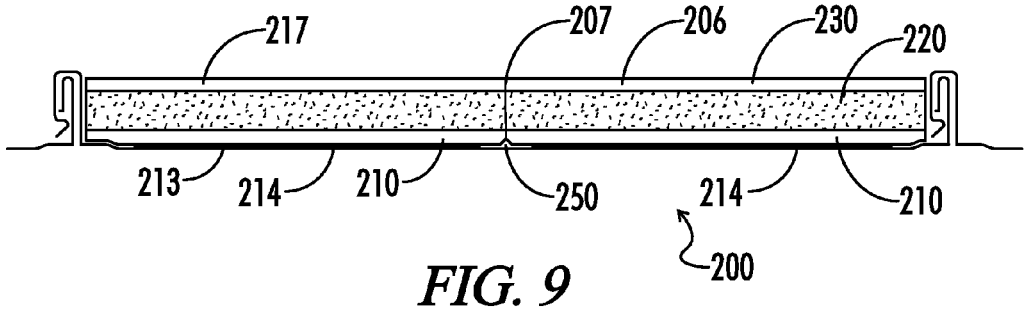
FIG. 9 is a rear view of the FIG. 7 embodiment illustrating the moisture channel and vertex of a roof vented closure strip.
Figure 10:
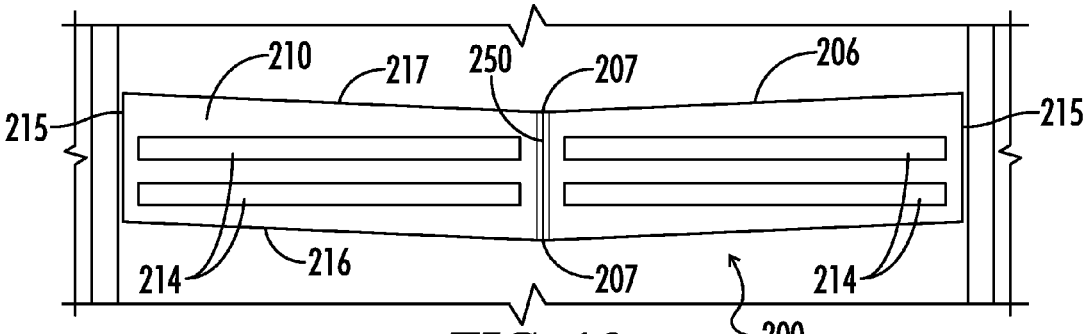
FIG. 10 is a bottom view of the FIG. 7 embodiment depicting the angle, vertex, and moisture channel of a roof vented closure strip.

Overview:

As illustrated in FIGS. 1 through 10, a roof closure ventilation system 100 comprises a structure 110 that includes a sloped roof 112 having multiple roofing sections joined at one or more sides with elongated ribs or overlapping elongated U-shaped projections typically referred to as major ribs 114, the structure further includes a roof ridge 120, a ridge slot 130 formed along the length of the roof ridge 120 permitting air or gas to vent from the interior of the structure 111 to the exterior, and a ridge cap 140. The roof closure ventilation system 100 further includes a roof vented closure strip 200 wherein the roof vented closure strip 200 is disposed adjacent each longitudinal side of the ridge slot 130 wherein the ridge slot 130 extends along the length of the roof ridge 120. The roof vented closure strip 200 is disposed between the sloped roof 112 and the ridge cap 140. The roof vented closure strip 200 comprises a profile piece 210, a filter material 220, and a top layer 230, wherein the profile piece 210, the filter material 220, and the top layer 230 combined include a depth sufficient to fill a space between the ridge cap 140 and the sloped roof 112. The roof vented closure strip 200 includes multiple materials of differing structural characteristics. The profile piece structure 210 includes: a lower surface 213, side surfaces 215, a front exterior surface 216, and a rear interior surface 217, wherein the lower surface 213 of the profile piece 210 conforms to the sloped roof 112 profile including when present the major ribs 114 and/or minor ribs 113. The profile piece structure 210 may include: a bridge 218 between the major ribs 114 and the top layer 230, and may include at least one substantially rectangular recess 240 formed between the top layer 230 of the roof vented closure strip 200 and the lower surface 213 of the profile piece 210 of the roof vented closure strip 200 and when included, between the bridges 218 of the roof vented closure strip 200. The filter material 220 fills the area between the lower surface 213 and the top layer 230 flush with the front exterior surface 216 as well as flush with the rear interior surface 217 such that air permeates the roof vented closure strip 200 through the filter material 220. An angle 206 is formed on the rear interior surface 217 of the roof vented closure strip 200 between the side surfaces 215 or when included between the adjoining bridges 218 on the rear interior surface 217 of the roof vented closure strip 200. The angle 206 slopes toward the front exterior surface 216. In addition, one or more moisture channels 250 extends laterally across the entire width of the roof vented closure strip 200 such that moisture on the rear interior surface 217 flows down the angle 206 to the moisture channel 250 and the moisture drains through the moisture channel 250 thus exiting the structure 110 and the roof vented closure strip 200.

Design Specifications:

The Building Structure with Roof Ridges, Roof Slot, Roof Panels, and Ridge Cap:

The building structure 110 includes a sloped roof 112 that may have multiple roofing sections joined at one or more sides with major ribs 114 or overlapping elongated U-shaped projections 114 and possibly minor ribs 113 between the major ribs 114, the structure further includes a roof ridge 120, a ridge slot 130 formed along the length of the roof ridge 120 permitting air or gas to vent from the interior of the structure 111 to the exterior, and a ridge cap 140 that covers the ridge slot to minimize rain entering the opening.

The Roof Vented Closure Strip:

The roof vented closure strip 200 comprises a profile piece 210, a filter material 220, and a top layer 230. The roof vented closure strip 200 is disposed adjacent each longitudinal side of the ridge slot 130 wherein the ridge slot 130 extends along the length of the roof ridge 120 and the roof vented closure strip 200 is disposed slightly down the sloped roof 112 from the ridge slot 130 comprising a lip 135 on the sloped roof 112 between the roof vented closure strip 200 and the ridge slot 130. The roof vented closure strip 200 is disposed between the sloped roof 112 and the ridge cap 140, wherein the profile piece 210, the filter material 220, and the top layer 230 combined include a depth sufficient to fill a space between the ridge cap 140 and the sloped roof 112.

The roof vented closure strip 200 includes multiple materials. A profile piece material 201, a filter material 202, and a top layer material 203 may have differing structural characteristics and densities. The profile piece material 201 and the top layer material 203 may comprise the same or different structural characteristics and/or density however the filter material 202 includes a different structural characteristic than the profile piece material 201 and the top layer material 203 for all embodiments. A preferred embodiment includes the profile piece 201 material comprising a closed cell polypropylene of approximately 1.3 pounds per cubic foot density; the filter material 202 comprising a non-woven polyester fiber of approximately 2.6 pounds per cubic foot density; and the top layer material 203 comprising a crosslink polyethylene foam of approximately 2 pounds per cubic foot density.

The profile piece 210 includes: a lower surface 213, side surfaces 215, a front exterior surface 216, and a rear interior surface 217, wherein the lower surface 213 of the profile piece 210 conforms to the sloped roof 112 with the major ribs 114 and when present the minor ribs 113. The profile piece 210 may further include: a bridge 218 and at least one substantially rectangular recess 240. The bridge 218 is formed between the major ribs 114 and the top layer 230. The recess 240 is formed between the top layer 230 of the roof vented closure strip 200 and the lower surface 213 of the profile piece 210 of the roof vented closure strip 200 and between the bridges 218 of the roof vented closure strip 200 wherein the rectangular recess 240 extends across the entire width of the roof vented closure strip 200 in a constant cross-section between the front exterior surface 216 and rear interior surface 217.

The filter material 220 fills the area between the top layer 230 and the lower surface 213 or profile piece 210. With the bridge 218 embodiments that include the substantially rectangular recess 240, the filter material 220 fills the substantially rectangular recess 240 between the bridges 218 such that the filter material 220 is flush with the front exterior surface 216 and the filter material 220 is also flush with the rear interior surface 217 wherein air permeates the entire lateral width of the roof vented closure strip 200 through the filter material 220. For embodiments without the bridges 218, and without the substantially rectangular recess 240, the filter material 220 extends the length of the profile piece 210 and is flush with the front exterior surface 216 and the filter material 220 is also flush with the rear interior surface 217 wherein air permeates the entire lateral width of the roof vented closure strip 200 through the filter material 220.

The top layer 230 extends the length of the profile piece 210, is flush with the front exterior surface 216, is also flush with the rear interior surface 217, and is further flush with the side surfaces 215.

All embodiments include an angle 206 formed on the rear interior surface 217 of the roof vented closure strip 200 such that the angle 206 slopes toward the front exterior surface 216. With some embodiments, a vertex 207 of the angle 206 may be approximately midway along the length of the filter material 220. In addition, one or more moisture channel 250 extends laterally across the entire width of the roof vented closure strip 200. The one or more moisture channel 250 may be disposed approximately midway along the length of the filter material 220 such that due to gravity moisture on the rear interior surface 217 flows along the lip 135 down along the angle 206 to the moisture channel 250 and then drains through the moisture channel 250 thus exiting the structure 110 and the roof vented closure strip 200. With the bridge 218 embodiments that include the substantially rectangular recess 240, the angle 206 may be formed on the rear interior surface 217 of the roof vented closure strip 200 between adjoining the bridges 218. The angle 206, of the rear interior surface 217 of the roof vented closure strip 200, slopes toward the front exterior surface 216 and a vertex 207 of the angle 206. The vertex 207 of the angle 206 may be approximately midway between adjoining the bridges 218, or between the minor ribs 113, or approximately midway along the length of the filter material 220, or in the proximity of the one or more minor rib 113. In addition, one or more moisture channel 250 extends laterally across the entire width of the roof vented closure strip 200. The one or more moisture channel 250 may be disposed approximately midway between the adjoining set of the bridges 218 or between the minor ribs 113 or in proximity to the vertex 207 of the angle 206 or in proximity to the minor ribs 113 such that moisture on the rear interior surface 217 flows down the angle 206 due to gravity to the moisture channel 250 and drains through the moisture channel 250 due to gravity thus exiting the structure 110 and the roof vented closure strip 200. The roof vented closure strip 200 may be manufactured with the angle 206 and vertex 207 of the rear interior surface 217 mirrored with the front exterior surface 216 for more efficient manufacture of the roof vented closure strip 200 as illustrated in FIGS. 3B, 4C and 7 through 10.

Fastening the Roof Vented Closure Strip:

The roof vented closure strip 200 includes adhesive 214 attached with the lower surface 213 of the profile piece 210 for fastening the roof vented closure strip 200 with the sloped roof panel 112. The adhesive 214 may be included on part or all of the lower side of the profile piece 210 except adhesive should not be applied in the moisture channel 250. Additionally, adhesive 214 may be included on the top of the top layer material 203 to secure the vented closure strip 200 to the bottom side of the ridge cap 140. Further, mechanical fastening may be used such as screws, nails or other standard roofing type fasteners as desired to fasten the ridge cap 140 with the strip 200 with the sloped roof panel 112.

Advantages/Improvements:

The current roof ventilation system 100 provides utility by removing heat and moisture at the ridge, which also helps prevent mold, rot and rust. This roof ventilation system 100 provides an advantage over previous systems that use only foam and also foam and contoured vent material but have no seal with the roof panel or the ridge cap, thus not providing a barrier to minimize storm-driven rain that may be forced up the panel, through the vent material and into the ridge opening. In addition, the current roof ventilation system provides self-drains to remove water that enters at the ridge at times from storm-driven rain, and also moisture or water that exist due to condensation at the ridge. Previous closure strips do not drain moisture that has intruded at the ridge, water that is trapped, and water that cannot escape. This includes water that is trapped by the seal between the roof panel, or if available the roof panel lip, and the lower side of the vented closure and cannot utilize gravity to drain the water down the roof panel. The current roof ventilation system 100 allows the water accumulated on the roof panel lip 135 to drain by gravity down the angle 206 formed on the interior side of the rear interior surface 217 until the water or moisture reaches the moisture channel 250. At the moisture channel 250, the water or moisture drains by gravity down and through the moisture channel 250 and the moisture exits the interior structure 111 of the building 110 as the water or moisture passes the front exterior surface 216.

The current roof ventilation system 100 also provides at least two or and preferably three separate materials for maximum utility. A preferred embodiment includes: a profile piece material 201, a filter material 202, and a top layer material 203 of differing structural characteristics, wherein the profile piece 201 material that engages the roof panel 112 includes a Closed Cell Polypropylene of approximately 1.3 pounds per cubic foot density for providing better weather resistance and better endurance over greater temperature extremes; the filter material 202 includes a Non-woven Polyester Fiber of approximately 2.6 pounds per cubic foot density that has a tough structural characteristic to enable keeping birds, insects, squirrels and other varmints from pulling out or chewing through the material (this venting material works well by passing through over 94% of all water vapor); and the top layer material 203 that engages the ridge cap 140 includes Crosslink Polyethylene Foam of approximately 2 pounds per cubic foot density (using a preferred embodiment with approximately 3/16 inch thickness of this material provides more pliable and has a greater tensile strength than other materials). Use of Crosslink Polyethylene Foam material for the top layer 230 of the roof vented closure strip 200 allows the venting material to be secured along its top side (to the top layer material 203) in addition to being secured along its bottom side to the profile material 201, making it much more difficult for varmints to pull out or be blown out, compared to competing products. Additionally, use of this material for the top layer of the roof vented closure strip 200 keeps the roof vented closure strip 200 from being damaged prior to installation as well as providing a tighter seal against the ridge cap 140 than other materials. Other options for the filter material 202 may include but are not limited to Reticulated Ether Foam and for the profile piece material may include but are not limited to Crosslink Polyethylene Foam.

What is claimed is:

1. A roof closure ventilation system comprising:

a structure including a sloped roof having multiple sloped roof sections with repeating major ribs, the structure further including an interior, an exterior, a roof ridge having a roof ridge length, a ridge cap, and a ridge slot formed along said roof ridge length permitting air to vent from the interior of said structure to the exterior of said structure, said ridge slot having a ridge slot length;

a roof vented closure strip disposed adjacent said ridge slot and extending along the length thereof, wherein said roof vented closure strip is disposed between said sloped roof and said ridge cap such that the structure of the roof closure ventilation system comprises a lip formed on said sloped roof between said ridge slot and said roof vented closure strip; said roof vented closure strip structure comprising:

a profile piece, an air permeable filter material, and a top layer, wherein said profile piece, said filter material, and said top layer combined include a depth sufficient to fill a space between said ridge cap and said sloped roof, and wherein said profile piece, said filter material, and said top layer include at least three materials of differing structural characteristics, wherein said profile piece structure comprises a lower surface forming the bottom of said roof vented closure strip, first and second side surfaces at opposite ends of said profile piece, a rear interior surface adjacent to and facing said ridge slot, a front exterior surface opposite said rear interior surface, a profile piece length extending from said first side surface to said second side surface, and a profile piece width extending from said front exterior surface to said rear interior surface, wherein said lower surface of said profile piece conforms to said sloped roof with said major ribs and said lower surface includes adhesive to secure said roof vented closure strip with said sloped roof, wherein said filter material is disposed between said top layer of said roof vented closure strip and said profile piece and on top of said lower surface, wherein said filter material extends from said front exterior surface to said rear interior surface wherein said rear interior surface of said roof vented closure strip comprises two slopes sloping towards said front exterior surface and meeting at a vertex approximately midway along the length of said profile piece, and wherein said lower surface comprises a moisture channel extending from said front exterior surface to said rear interior surface, wherein moisture on said lip flows down said slopes to said moisture channel and said moisture drains through said moisture channel thus exiting said structure and said roof vented closure strip.

2. The ventilation system as set forth in claim 1 wherein said profile piece material structure includes a closed cell polypropylene, said filter material structure includes a non-woven polyester fiber, and said top layer material structure includes a crosslink polyethylene foam.

3. The ventilation system as set forth in claim 2 wherein said closed cell polypropylene includes an approximately 1.3 pounds per cubic foot density, said non-woven polyester fiber includes an approximately 2.6 pounds per cubic foot density, and said crosslink polyethylene foam includes an approximately 2 pounds per cubic foot density.

4. The ventilation system as set forth in claim 1, wherein said moisture channel is located at said vertex.

5. The ventilation system as set forth in claim 1 including fasteners for securing said ridge cap with said roof vented closure strip with said sloped roof.

6. A roof closure ventilation system comprising:

a structure including a sloped roof having multiple sloped roof sections with repeating major ribs, the structure further including an, interior, an exterior, a roof ridge having a roof ridge length, a ridge cap, and a ridge slot formed along said roof ridge length permitting air to vent from the interior of said structure to the exterior of said structure, said ridge slot having a ridge slot length;

a roof vented closure strip disposed adjacent said ridge slot and extending along the length thereof, wherein said roof vented closure strip is disposed between said sloped roof and said ridge cap such that the structure of the roof closure ventilation system comprises a lip formed on said sloped roof between said ridge slot and said roof vented closure strip; said roof vented closure strip structure comprising:

a profile piece, an air permeable filter material, and a top layer, wherein said profile piece, said filter material, and said top layer combined include a depth sufficient to fill a space between said ridge cap and said sloped roof, and wherein said profile piece, said filter material, and said top layer include at least three materials of differing structural characteristics;

wherein said profile piece structure comprises a lower surface forming the bottom of said roof vented closure strip, first and second side surfaces at opposite ends of said profile piece, a rear interior surface adjacent to and facing said ridge slot, a front exterior surface opposite said rear interior surface, a profile piece length extending from said first side surface to said second side surface, a profile piece width extending from said front exterior surface to said rear interior surface, at least two bridges, and at least one substantially rectangular recess;

wherein said lower surface of said profile piece conforms to said sloped roof with said major ribs and said lower surface includes adhesive to secure said roof vented closure strip with said sloped roof, wherein each said bridge is disposed between said major ribs and said top layer, wherein said substantially rectangular recess is disposed between said top layer of said roof vented closure strip and said lower surface of said profile piece and between said bridges, and wherein said rectangular recess extends from said front exterior surface to said rear interior surface in a constant cross-section;

wherein said filter material fills said substantially rectangular recess flush with said front exterior surface and flush with said rear interior surface;

wherein said rear interior surface of said roof vented closure strip between adjoining said bridges comprises two slopes sloping towards said front exterior surface and meeting at a vertex approximately midway between adjoining said bridges; and wherein, said lower surface comprises a moisture channel extending from said front exterior surface to said rear interior surface, and said moisture channel is disposed approximately midway between said bridges, wherein moisture on said lip flows down said slopes to said moisture channel and said moisture drains through said moisture channel thus exiting said structure and said roof vented closure strip.

7. The ventilation system as set forth in claim 6 wherein said profile piece material structure includes a closed cell polypropylene, said filter material structure includes a non-woven polyester fiber, and said top layer material structure includes a crosslink polyethylene foam.

8. The ventilation system as set forth in claim 7 wherein said polypropylene material includes an approximately 1.3 pounds per cubic foot density, said non-woven polyester fiber includes an approximately 2.6 pounds per cubic foot density, and said crosslink polyethylene foam includes an approximately 2 pounds per cubic foot density.

9. The ventilation system as set forth in claim 6 including fasteners for securing said ridge cap with said roof vented closure strip with said sloped roof.

10. The ventilation system as set forth in claim 9 including fasteners for securing said ridge cap with said roof vented closure strip with said sloped roof through said bridges and through said roof vented closure strip between bridges.

11. The ventilation system as set forth in claim 6, wherein said moisture channel is located at said vertex.

12. The ventilation, system as set forth in claim 1, wherein said filter material extends from said first side surface to said second side surface.

* * * * *